US007367600B1

(12) United States Patent
Lew et al.

(10) Patent No.: US 7,367,600 B1
(45) Date of Patent: May 6, 2008

(54) LAWN DEBRIS HANDLING SYSTEM

(76) Inventors: Alan M. Lew, 426 - 13th Ave. NE., St. Petersburg, FL (US) 33701; Scott P. Davidson, 3045 Homestead Ct., Clearwater, FL (US) 33759

( * ) Notice: Subject to any disclaimer, the term of this patent is extended or adjusted under 35 U.S.C. 154(b) by 257 days.

(21) Appl. No.: 11/104,834

(22) Filed: Apr. 13, 2005

(51) Int. Cl.
*B65F 5/00* (2006.01)

(52) U.S. Cl. ..... 294/1.1; 294/152

(58) Field of Classification Search ..... 294/1.1, 294/149, 152; 56/329; 15/257.1
See application file for complete search history.

(56) References Cited

U.S. PATENT DOCUMENTS 4,037,778 A * 7/1977 Boyle ..... 141/390
4,760,982 A * 8/1988 Cooke ..... 248/99
4,884,603 A * 12/1989 Simpson ..... 141/390
4,890,873 A * 1/1990 Prada et al. ..... 294/152
5,065,965 A * 11/1991 Aulabaugh ..... 248/99
5,129,609 A * 7/1992 Tobin ..... 248/97
5,147,102 A * 9/1992 Dyer, Jr. ..... 294/152

* cited by examiner

*Primary Examiner*—Dean J Kramer
(74) *Attorney, Agent, or Firm*—Edward P Dutkiewicz

(57) ABSTRACT

A sheet has a long input edge and a short remote edge. The sheet has parallel side edges. The side edges extend at right angles from the ends of the input edge. Angled side edges extend from the ends of the remote edge to the ends of the parallel side edges. A pair of exterior fold lines extend from the ends of the remote edge. A pair of interior fold lines extend from intermediate regions of the remote edge parallel with the parallel side edges.

5 Claims, 4 Drawing Sheets

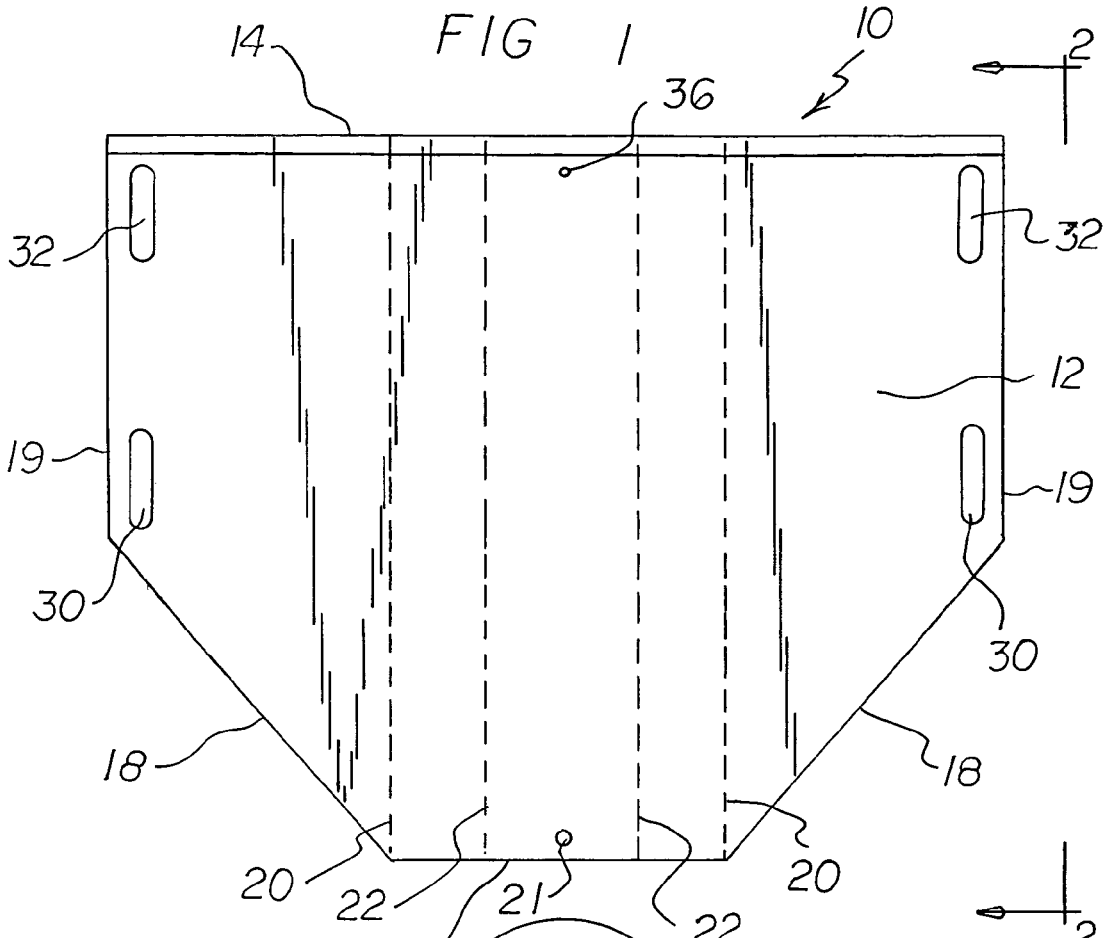
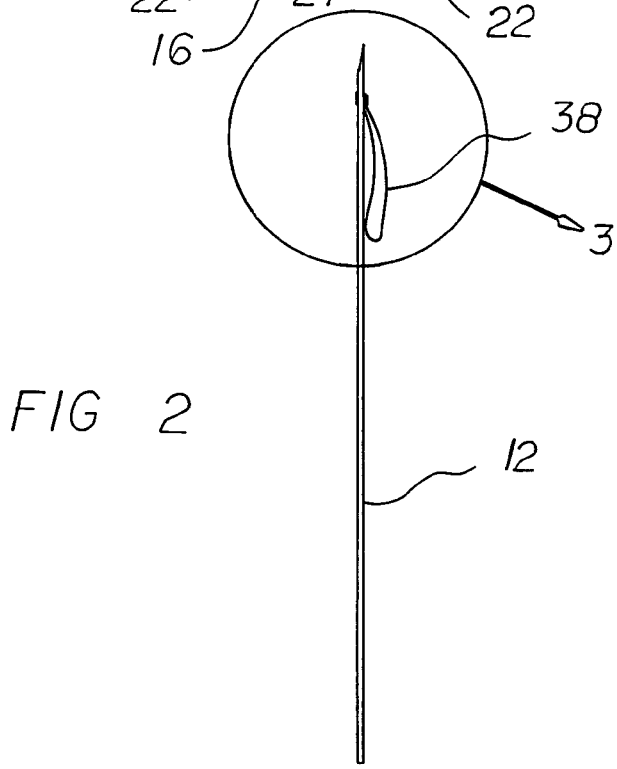
FIG 2

FIG 5
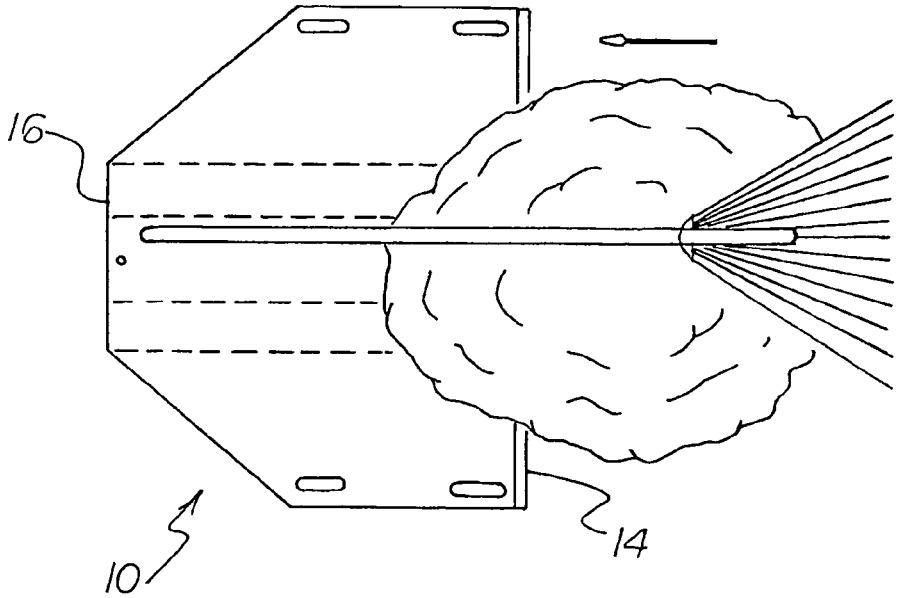
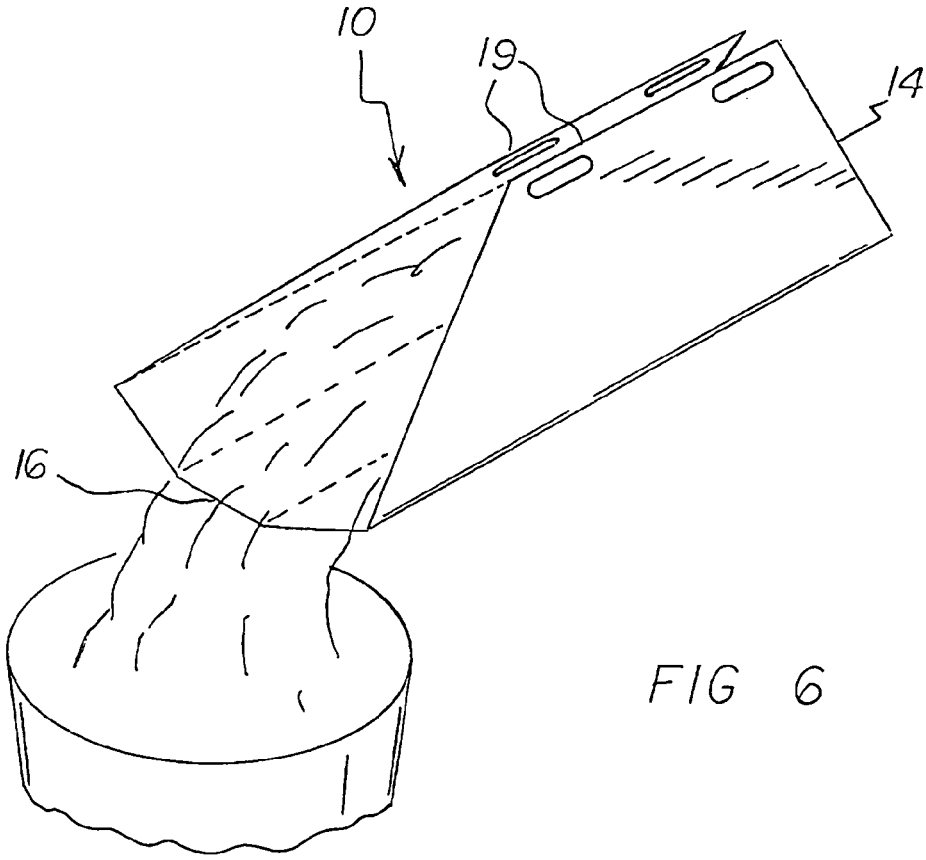
FIG 6

FIG 7
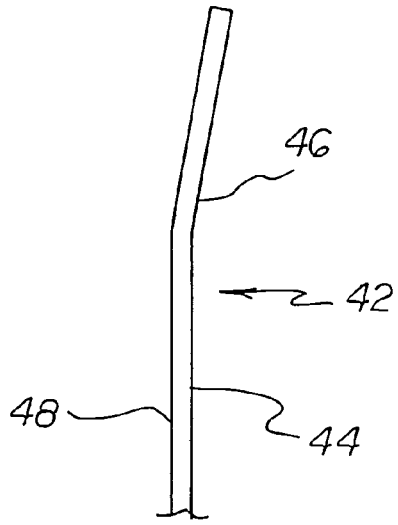
FIG 8
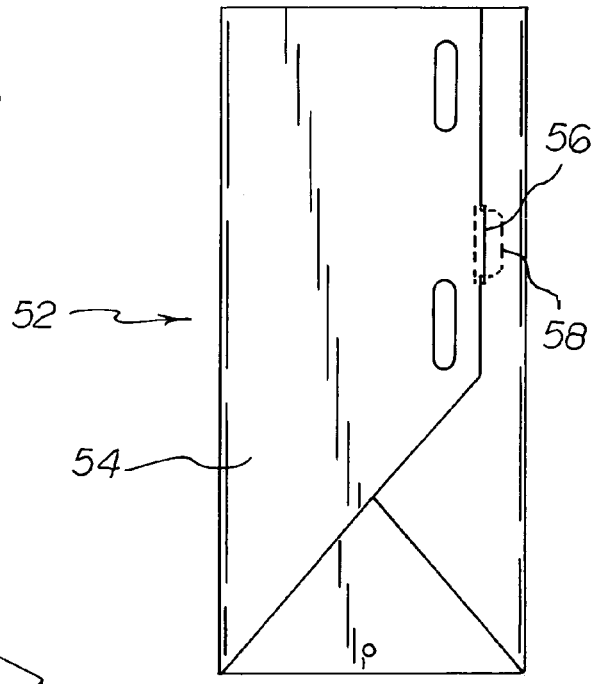
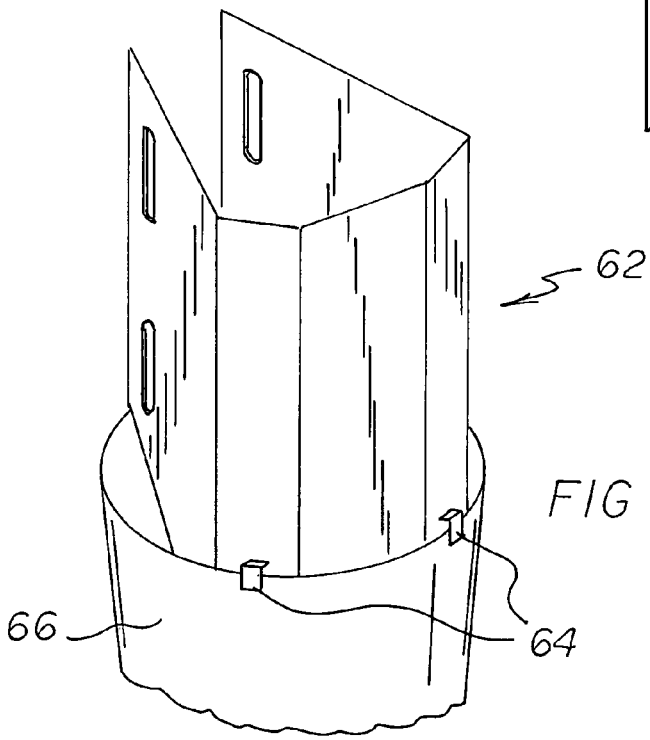
FIG 9

LAWN DEBRIS HANDLING SYSTEM

BACKGROUND OF THE INVENTION

1. Field of the Invention

The present invention relates to a lawn debris handling system and more particularly pertains to assisting users in collecting and removing fallen leaves and other debris from yards in an economical and efficient manner.

2. Description of the Prior Art

The use of lawn debris systems of known designs and configurations is known in the prior art. More specifically, lawn debris systems of known designs and configurations previously devised and utilized for the purpose of removing debris through known methods and apparatuses consist basically of familiar, expected and obvious structural configurations, notwithstanding the myriad of designs encompassed by the crowded prior art which has been developed for the fulfillment of countless objectives and requirements.

By way of example, U.S. Pat. No. 3,312,263 issued Apr. 4, 1967 to Wahlstrom relates to a tote bag for fallen leaves. U.S. Pat. No. 5,129,609 issued Jul. 14, 1992 to Tobin relates to a flexible trash bag support apparatus. U.S. Pat. No. 6,202,718 issued Mar. 20, 2001 to Innocenti relates to a multi-function transporter for yard debris. Lastly, U.S. Pat. No. 6,708,742 issued Mar. 23, 2004 to Weathers relates to a leaf and debris chute.

While these devices fulfill their respective, particular objectives and requirements, the aforementioned patents do not describe a lawn debris handling system that allows assisting users in collecting and removing fallen leaves and other debris from yards in an economical and efficient manner.

In this respect, the lawn debris handling system according to the present invention substantially departs from the conventional concepts and designs of the prior art, and in doing so provides an apparatus primarily developed for the purpose of assisting users in collecting and removing fallen leaves and other debris from yards in an economical and efficient manner.

Therefore, it can be appreciated that there exists a continuing need for a new and improved lawn debris handling system which can be used for assisting users in collecting and removing fallen leaves and other debris from yards in an economical and efficient manner. In this regard, the present invention substantially fulfills this need.

SUMMARY OF THE INVENTION

In view of the disadvantages inherent in the known types of lawn debris systems of designs and configurations now present in the prior art, the present invention provides an improved lawn debris handling system. As such, the general purpose of the present invention, which will be described subsequently in greater detail, is to provide a new and improved lawn debris handling system and method which has all the advantages of the prior art and none of the disadvantages.

To attain this, the present invention essentially comprises a lawn debris handling system. First provided is a sheet of thin sheet material. The sheet of material is preferably corrugated plastic with limited flexibility. The sheet material has a long input edge. The input edge has ends. The ends are spaced about 48 inches. The sheet material has a parallel, centrally positioned, short remote edge. The remote edge has ends. The ends are spaced about 18 inches. A distance of about 40 inches is provided between the input and remote edges. The sheet has parallel side edges. The side edges extend downwardly at right angles from the ends of the input edge. The side edges have ends. The ends are spaced about 22 inches. The sheet has angled side edges. The side edges extend upwardly at obtuse angles from the ends of the remote edge to the ends of the parallel side edges remote from the input edge.

A pair of exterior fold lines is provided. The exterior fold lines extend upwardly from the ends of the remote edge. The exterior fold lines are parallel with the parallel side edges. A distance of about 18 inches is provided between the exterior fold lines.

Provided next is a pair of interior fold lines. The interior fold lines extend upwardly from intermediate regions of the remote edge parallel and are each at a distance of about 5 inches from its adjacent exterior fold lines.

An upper surface and a lower surface are provided. The upper surface is tapered along the entire length of the input edge. In this manner a chamfer is formed. The chamfer facilitates the moving of debris onto the upper surface of the sheet during operation and use.

A pair of generally oval primary slots is provided next. The primary slots are provided parallel with and adjacent to the parallel side edges in proximity to the angled side edges.

Provided next is a pair of generally oval secondary slots. The secondary slots are provided parallel with and adjacent to the parallel side edges in proximity to the input edge.

Further provided is a circular aperture. The circular aperture is provided in proximity to the midpoint of the remote edge.

Provided last is a rivet. The rivet extends through the sheet in proximity to the midpoint of the input edge. An elastic strap is provided. The elastic strap is secured to the rivet on the lower face of the sheet. The strap has a circumference of about 38 inches. The strap encompasses the sheet when folded upon itself along the exterior fold lines.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore, an object of the present invention to provide a new and improved lawn debris handling system which has all of the advantages of the prior art lawn debris systems of known designs and configurations and none of the disadvantages.

It is another object of the present invention to provide a new and improved lawn debris handling system which may be easily and efficiently manufactured and marketed.

It is further object of the present invention to provide a new and improved lawn debris handling system which is of durable and reliable constructions.

An even further object of the present invention is to provide a new and improved lawn debris handling system which is susceptible of a low cost of manufacture with regard to both materials and labor, and which accordingly is then susceptible of low prices of sale to the consuming public, thereby making such lawn debris handling system economically available to the buying public.

Even still another object of the present invention is to provide a lawn debris handling system for assisting users in collecting and removing fallen leaves and other debris from yards in an economical and efficient manner.

Lastly, it is an object of the present invention to provide a new and improved lawn debris handling system. A sheet has a long input edge and a short remote edge. The sheet has parallel side edges, extending at right angles from the ends of the input edge. Angled side edges extend from the ends of the remote edge to the ends of the parallel side edges. A pair of exterior fold lines extend from the ends of the remote edge. A pair of interior fold lines extend from intermediate regions of the remote edge parallel with the parallel side edges.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a lawn debris handling system constructed in accordance with the principles of the present invention.

FIG. 2 is a side elevational view of the system taken along line 2-2 of FIG. 1.

FIG. 5 is a front elevational view similar to FIG. 1 but illustrating the system with a rake and debris during operation and use.

FIG. 6 is a perspective view similar to FIGS. 1 and 5 but illustrating the system with debris and a garbage can during operation and use.

FIG. 7 an enlarged side elevational view of the upper region of the system similar to FIG. 3 but illustrating an alternate embodiment of the invention.

FIG. 8 is a front elevational view similar to FIG. 4 showing a folded orientation but illustrating another alternate embodiment of the invention.

FIG. 9 is a perspective view similar to FIG. 6 showing the system with debris and a garbage can during operation and use but illustrating yet another alternate embodiment of the invention.

The same reference numerals refer to the same parts throughout the various Figures of the primary embodiment of the invention as well as the various alternate embodiments of the invention.

DESCRIPTION OF THE PREFERRED EMBODIMENT

Figure 3:
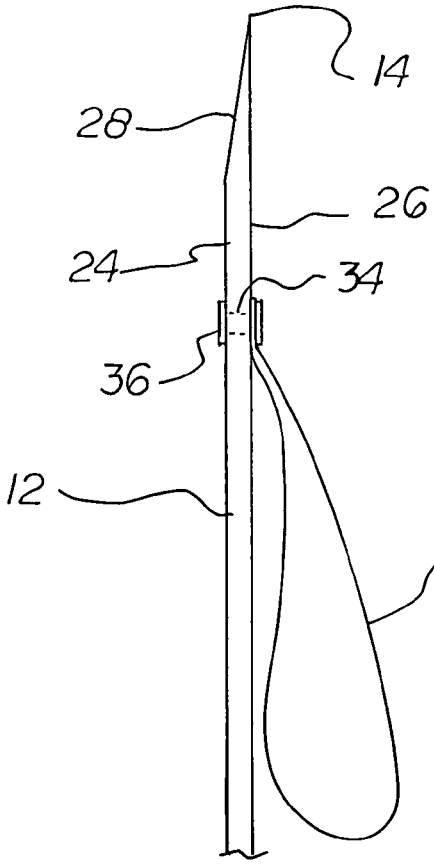
FIG. 3 is an enlarged side elevational view of the upper region of the system taken at circle 3 of FIG. 2.

With reference now to the drawings, and in particular to FIG. 1 thereof, the preferred embodiment of the new and improved lawn debris handling system embodying the principles and concepts of the present invention and generally designated by the reference numeral 10 will be described.

The present invention, the lawn debris handling system 10 is comprised of a plurality of components. Such components in their broadest context include a sheet and pairs of fold lines. Such components are individually configured and correlated with respect to each other so as to attain the desired objective.

First provided is a sheet 12 of thin sheet material. The sheet of material is selected from a class of materials having limited flexibility, including corrugated plastic, corrugated cardboard, plywood, and sheet metal, preferably corrugated plastic in the primary embodiment. The sheet material has a long input edge 14. The input edge has ends. The ends are spaced about 48 inches. The sheet material has a parallel, centrally positioned, short remote edge 16. The remote edge has ends. The ends are spaced about 18 inches. A distance of about 40 inches is provided between the input and remote edges. The sheet has parallel side edges 19. The side edges extend downwardly as shown in FIG. 1 at right angles from the ends of the input edge. The side edges have ends. The ends are spaced about 22 inches. The sheet has angled side edges 18. The side edges extend upwardly as shown in FIG. 1 at obtuse angles from the ends of the remote edge to the ends of the parallel side edges remote from the input edge.

A pair of exterior fold lines 20 is provided. The exterior fold lines extend upwardly as shown in FIG. 1 from the ends of the remote edge. The exterior fold lines are parallel with the parallel side edges. A distance of about 18 inches is provided between the exterior fold lines.

Provided next is a pair of interior fold lines 22. The interior fold lines extend upwardly as shown in FIG. 1 from intermediate regions of the remote edge parallel. The parallel side edges are each at a distance of about 5 inches from its adjacent exterior fold lines.

Figure 4:
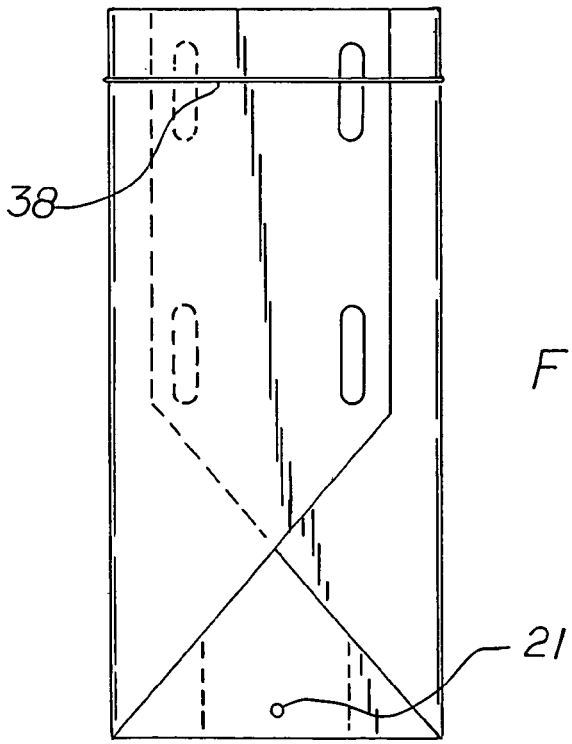
FIG. 4 is a front elevational view similar to FIG. 1 but illustrating the system in a folded orientation.

The fold lines provide greater flexibility than the remainder of the sheet. The exterior fold lines allow for folding the sheet to a fully folded orientation as for storage. Note FIG. 4. The interior fold lines, along with the exterior fold lines, allow for partially folding the sheet to a partially folded orientation as for lifting and transporting and dispensing leaves and debris from the sheet to a trash can. Note FIG. 6. Such partially folded orientation also allows a user to more readily carry the sheet through the oval slots as will be more fully described hereinafter.

An upper surface 24 and a lower surface 26 are provided. The upper surface is tapered along the entire length of the input edge. In this manner a chamfer 28 is formed. The chamfer facilitates the moving of debris onto the upper surface of the sheet during operation and use. The sheet is adapted to rest flat upon a lawn during operation and use whereby a user may sweep or rake leaves and debris over the chamfer of the input end, onto the upper surface. Thereafter the sheet may be folded to entrap the leaves so that they may be dispensed into a trash can or the like. Compare FIGS. 5 and 6.

It should be understood that the present invention is adapted for a wide variety of uses beyond the leaves and lawn debris as discussed above. By way of example, the present invention is adapted for industrial and warehouse debris cleanup and many other like applications.

A pair of generally oval primary slots 30 is provided next. The primary slots are provided parallel with and adjacent to the parallel side edges in proximity to the angled side edges.

Provided next is a pair of generally oval secondary slots 32. The secondary slots are provided parallel with and adjacent to the parallel side edges in proximity to the input edge.

Further provided is a circular aperture 21. The circular aperture is provided in proximity to the midpoint of the remote edge of the sheet. The circular aperture may be used for hanging the sheet from a nail as during storage.

Provided last is a rivet 36 in an aperture 34. The rivet extends through the sheet in proximity to the midpoint of the remote edge. An elastic strap 38 is provided. The elastic strap is secured to the rivet on the lower face of the sheet. The strap has a circumference of about 38 inches. The strap encompasses the sheet when folded upon itself along the exterior fold lines.

In an alternate embodiment of the present invention the sheet 44 is fabricated of plastic. Note the embodiment of FIG. 7. The sheet has a bend 46 adjacent to the input edge and parallel therewith. The lower surface of the sheet forms an obtuse angle adjacent to the input edge. In this manner the receipt of debris moved by a user onto the upper surface 48 of the sheet is facilitated.

In another alternate embodiment of the present invention the sheet 54 includes a slit 56. Note the embodiment of FIG. 8. The slit is adjacent to and parallel with the exterior fold line. An opposed remote edge is formed. A tab 58 is provided in the opposed remote edge. The tab is positionable within the slot. In this manner the sheet is retained in a folded orientation as for storage and transportation.

In the last alternate embodiment of the present invention, the system further includes a pair of L-shaped tabs 64. Note the embodiment of FIG. 9. The tabs are secured at laterally spaced locations intermediate the ends on the lower surface of the sheet for being supported by a garbage can 66 during emptying.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lawn debris handling system comprising:

a sheet having a long input edge and a parallel short remote edge, the sheet having parallel side edges extending at right angles from the ends of the input edge and angled side edges extending from the ends of the remote edge to the ends of the parallel side edges;

a pair of exterior fold lines extending from the ends of the remote edge and a pair of interior fold lines extending from intermediate regions of the remote edge parallel with the parallel side edges: and a pair of generally oval primary slots in the sheet parallel with and adjacent to the parallel side edges in proximity to the angled side edges and a pair of generally oval secondary slots in the sheet parallel with and adjacent to the parallel side edges in proximity to the input edge.

2. A lawn debris handling system comprising:

a sheet having a long input edge and a parallel short remote edge, the sheet having parallel side edges extending at right angles from the ends of the input edge and angled side edges extending from the ends of the remote edge to the ends of the parallel side edges;

the sheet also having an upper surface and a lower surface and further including a rivet extending through the sheet in proximity to the midpoint of the input edge with an elastic strap secured to the rivet on the lower surface of the sheet, the strap having a circumference to encompass the sheet when folded upon itself along the exterior fold lines; and a pair of exterior fold lines extending from the ends of the remote edge and a pair of interior fold lines extending from intermediate regions of the remote edge parallel with the parallel side edges.

3. A lawn debris handling system comprising:

a sheet having a long input edge and a parallel short remote edge, the sheet having parallel side edges extending at right angles from the ends of the input edge and angled side edges extending from the ends of the remote edge to the ends of the parallel side edges;

a pair of exterior fold lines extending from the ends of the remote edge and a pair of interior fold lines extending from intermediate regions of the remote edge parallel with the parallel side edges; and a slit adjacent to and parallel with the exterior fold line and an opposed remote edge formed with a tab positionable within the slot to retain the sheet in a folded orientation as for storage and transportation.

4. A lawn debris handling system comprising:

a sheet having a long input edge and a parallel short remote edge, the sheet having parallel side edges extending at right angles from the ends of the input edge and angled side edges extending from the ends of the remote edge to the ends of the parallel side edges;

the sheet also having an upper surface and a lower surface and further including a pair of L-shaped tabs secured at laterally spaced locations intermediate the ends on the lower surface of the sheet for being supported by a garbage can during emptying; and a pair of exterior fold lines extending from the ends of the remote edge and a lair of interior fold lines extending from intermediate regions of the remote edge parallel with the parallel side edges.

5. A lawn debris handling system for assisting users in collecting and removing fallen leaves and other debris from yards in an economical and efficient manner comprising, in combination:

a sheet of thin sheet material corrugated cardboard with limited flexibility, the sheet having a long input edge with ends spaced about 48 inches and a parallel, centrally positioned, short remote edge with ends spaced about 18 inches and with a distance of about 40 inches between the input and remote edges, the sheet having parallel side edges extending downwardly at right angles from the ends of the input edge with ends spaced about 22 inches, the sheet having angled side edges extending upwardly at obtuse angles from the ends of the remote edge to the ends of the parallel side edges remote from the input edge;

a pair of exterior fold lines extending upwardly from the ends of the remote edge parallel with the parallel side edges with a distance of about 18 inches between the exterior fold lines;

a pair of interior fold lines extending upwardly from intermediate regions of the remote edge parallel with the parallel side edges each at a distance of about 5 inches from the exterior fold lines;

the sheet having an upper surface and a lower surface with the upper surface at the input edge being tapered along the entire length of the input edge to thereby form a chamfer to facilitate the moving of debris on to the upper surface of the sheet during operation and use;

a pair of generally oval primary slots in the sheet parallel with and adjacent to the parallel side edges in proximity to the angled side edges;

a pair of generally oval secondary slots in the sheet parallel with and adjacent to the parallel side edges in proximity to the input edge;

a circular aperture in the sheet in proximity to the midpoint of the remote edge; and a rivet extending through the sheet in proximity to the midpoint of the input edge with an elastic strap secured to the rivet on the lower surface of the sheet, the strap having a circumference of about 38 inches to encompass the sheet when folded upon itself along the exterior fold lines.

* * * * *